US007847750B2

(12) United States Patent
Ohba et al.

(10) Patent No.: US 7,847,750 B2
(45) Date of Patent: Dec. 7, 2010

(54) ANTENNA DEVICE ADAPTED FOR PORTABLE RADIO APPARATUS

(75) Inventors: Isao Ohba, Tokyo (JP); Takashi Amano, Saitama-ken (JP); Akihiro Tsujimura, Tokyo (JP); Satoshi Mizoguchi, Tokyo (JP); Koichi Sato, Tokyo (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 449 days.

(21) Appl. No.: 11/973,807

(22) Filed: Oct. 10, 2007

(65) Prior Publication Data

US 2008/0143627 A1 Jun. 19, 2008

(30) Foreign Application Priority Data

Dec. 15, 2006 (JP) ..... 2006-338273

(51) Int. Cl.
*H01Q 1/00* (2006.01)

(52) U.S. Cl. ..... 343/787

(58) Field of Classification Search ..... 343/702, 343/729, 787, 788
See application file for complete search history.

(56) References Cited

U.S. PATENT DOCUMENTS 7,088,304 B2 * 8/2006 Endo et al. ..... 343/788
7,515,111 B2 * 4/2009 Tsujimura et al. ..... 343/787
2004/0046699 A1 * 3/2004 Amano et al. ..... 343/702
2005/0162331 A1 * 7/2005 Endo et al. ..... 343/788
2007/0052600 A1 * 3/2007 Kamitani et al. ..... 343/702

FOREIGN PATENT DOCUMENTS

JP 2001-156484 A 6/2001
JP 2006-222873 A 8/2006

* cited by examiner

*Primary Examiner*—Michael C Wimer
*Assistant Examiner*—Kyana R Robinson
(74) *Attorney, Agent, or Firm*—Holtz, Holtz, Goodman & Chick, PC

(57) ABSTRACT

An antenna device includes a printed circuit board and an antenna element. The printed circuit board has a face a portion of which is formed by a conductive layer overlaid with a magnetic material layer made of anisotropic magnetic material. The magnetic material layer is arranged in such a way that a hard magnetization axis of the anisotropic magnetic material is directed almost parallel to the face. The antenna element is arranged almost parallel to the printed circuit board on a side of the face. The antenna element is arranged in such a way that an antenna current distributed on the antenna element if the antenna element is excited is directed almost perpendicular to the hard magnetization axis.

13 Claims, 8 Drawing Sheets

ANTENNA DEVICE ADAPTED FOR PORTABLE RADIO APPARATUS

CROSS REFERENCE TO RELATED APPLICATIONS

This application is based upon and claims the benefit of priority from the prior Japanese Patent Application No. 2006-338273 filed on Dec. 15, 2006; the entire contents of which are incorporated herein by reference.

BACKGROUND OF THE INVENTION

1. Field of the Invention

The present invention relates to an antenna device, and in particular to an antenna device adapted for portable radio apparatus.

2. Description of the Related Art

A portable radio apparatus such as a mobile phone often has a limited mounting space, and thus may suffer from a problem of interference caused by electromagnetic or electrostatic capacitive couplings among an antenna and each of portions of an electrical circuit of the radio apparatus. In particular, the antenna may often face a problem of degraded radiation efficiency.

To the above problems, possible solutions using magnetic material have been proposed. For instance, a conventional portable radio apparatus is disclosed in Japanese Patent Publication of Unexamined Applications (Kokai), No. 2001-156484.

More specifically, the radio apparatus disclosed in JP 2001-156484 includes a printed circuit board, a shield case for shielding a portion of the printed circuit board, and an antenna configured to be pulled out of the shield case and to be extended.

The radio apparatus disclosed in JP 2001-156484 may improve a shielding effect, for one thing, by strengthening electrical connections between the shield case and a ground pattern of the printed circuit board in a direction perpendicular to a direction of a radio frequency current induced on the shield case.

The radio apparatus disclosed in JP 2001-156484 may improve the shielding effect, for another thing, by layering magnetic films having an easy magnetization axis in the direction of the radio frequency current induced on the shield case so as to raise a coefficient of reflection of radio waves.

Another example of the possible solutions is a conventional antenna device adapted for a communication apparatus disclosed in Japanese Patent Publication of Unexamined Applications (Kokai), No. 2006-222873.

More specifically, the antenna device disclosed in JP 2006-222873 includes a dipole antenna (a feed element) and a parasitic element such as a conductor plate. The antenna device disclosed in JP 2006-222873 may improve impedance matching and a wavelength shortening effect for downsizing by forming the parasitic element from magnetic material or a metal plate with a surface layered by magnetic material, and by controlling parameters of the magnetic material (relative magnetic permeability, relative dielectric constant and a depth) properly.

The radio apparatus disclosed in JP 2001-156484 has an extendable antenna, and is configured to prevent a radio frequency current from being conducted into the portion of the printed circuit board shielded by the shield case by lowering impedance of the shield case so that the radio frequency current may easily flow on the shield case.

The configuration of the radio apparatus disclosed in JP 2001-156484 may hardly be applied to a radio apparatus including a built-in antenna, as, e.g., a positional relationship between the built-in antenna and a printed circuit board is different from a positional relationship between the extendable antenna and the printed circuit board of the radio apparatus disclosed in JP 2001-156484.

The configuration of the radio apparatus disclosed in JP 2001-156484 may hardly be applied in a case where it is difficult to define a direction of the easy magnetization axis uniquely, as the magnetic films may not be layered until the direction of the easy magnetization axis is defined.

The above disclosure of the antenna device in JP 2006-222873 gives an embodiment of the antenna device including magnetic material having relative magnetic permeability of around 10, and refers to neither isotropy/anisotropy of the magnetic material, nor possibility of further improvement of antenna characteristics of radio apparatus by using anisotropic magnetic material of higher relative magnetic permeability.

SUMMARY OF THE INVENTION

Accordingly, an object of the present invention is to improve an antenna characteristic by using anisotropic magnetic material showing high magnetic permeability selectively depending upon a direction of a magnetic field.

To achieve the above object, according to one aspect of the present invention an antenna device includes a printed circuit board and an antenna element. The printed circuit board has a face a portion of which is formed by a conductive layer overlaid with a magnetic material layer made of anisotropic magnetic material. The magnetic material layer is arranged in such a way that a hard magnetization axis of the anisotropic magnetic material is directed almost parallel to the face. The antenna element is arranged almost parallel to the printed circuit board on a side of the face. The antenna element is arranged in such a way that an antenna current distributed on the antenna element if the antenna element is excited is directed almost perpendicular to the hard magnetization axis.

DETAILED DESCRIPTION OF THE INVENTION

Figure 1:
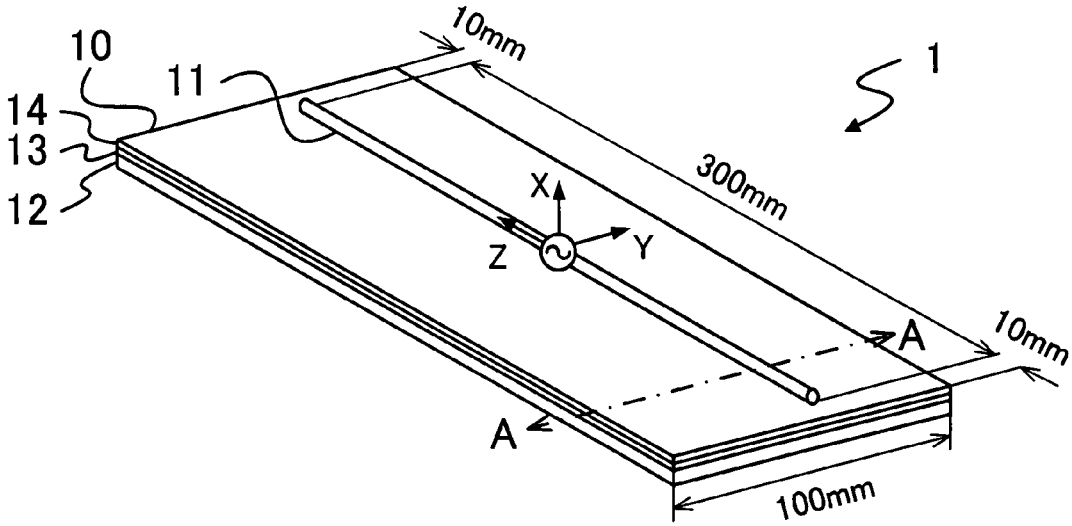
FIG. 1 is a perspective view of an antenna device 1 of a first embodiment of the present invention, including an antenna element, a printed circuit board (PCB) and a magnetic material layer.

Hereinafter, embodiments of the present invention will be described in detail. In following descriptions, terms such as upper, lower, left, right, horizontal or vertical used while referring to a drawing shall be interpreted on a page of the drawing unless otherwise noted. Besides, a same reference numeral given in no less than two drawings shall represent a same member or a same portion.

Figure 2:
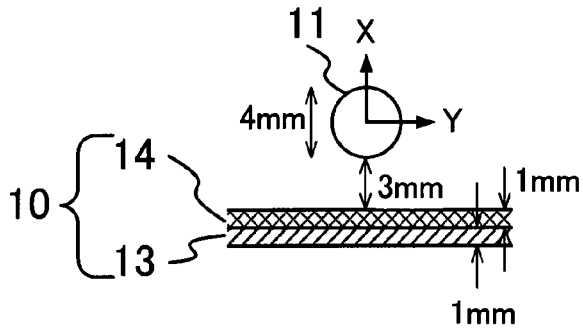
FIG. 2 is a sectional view of the printed circuit board and the antenna element of the first embodiment to show conditions of simulation for estimating an effect of the first embodiment.

A first embodiment of the present invention will be described with reference to FIGS. 1-5. FIG. 1 is a perspective view of an antenna device 1 of the first embodiment of the present invention to show a configuration of the antenna device 1. In FIGS. 1-2, parameter values of simulation which will be explained later, such as a length of each portion of the antenna device 1, are shown for convenience of explanation. Being considered as exemplary only, the parameter values shown in FIGS. 1-2 will not limit the present invention.

The antenna device 1 has a printed circuit board (PCB) 10 and an antenna element 11. An upper face of the PCB 10 is formed in such a way that a base material 12 is provided with a conductive layer 13 thereon, and is further overlaid with a magnetic material layer 14.

The antenna element 11 is a half-wavelength dipole antenna configured to be balanced-fed at a middle portion. The antenna element 11 is 300 millimeters (mm) long and has a resonance frequency of 500 megahertz (MHz). The antenna element 11 is arranged almost parallel to a long side of the PCB 10, where an end and another end of the antenna element 11 are 10 mm away from upper and lower short sides of the PCB 10, respectively.

Each of the short sides of the PCB 10 is 100 mm long. For convenience of explanation hereafter, an orthogonal coordinate system is defined to have an X-axis which is almost perpendicular to the face of the PCB 10, a Y-axis which is almost parallel to the short side of the PCB 10, and a Z-axis which is almost parallel to the long side of the PCB 10.

The magnetic material layer 14 is made of anisotropic magnetic material such as nanogranular material or nanocolumnar material. The magnetic material layer 14 is arranged in such a way that a hard magnetization axis of the magnetic material layer 14 is directed parallel to the Y-axis. In that case, a magnetic flux density and a magnetic field are related to each other in the orthogonal coordinate system shown in FIG. 1 as represented by a following equation:

$$\begin{pmatrix} Bx \\ By \\ Bz \end{pmatrix} = \begin{pmatrix} 1 & 0 & 0 \\ 0 & \mu y & 0 \\ 0 & 0 & 1 \end{pmatrix} \begin{pmatrix} Hx \\ Hy \\ Hz \end{pmatrix} \quad \text{(Eq. 1)}$$

where μy is relative magnetic permeability in the direction of the hard magnetization axis of the magnetic material layer 14, i.e., parallel to—the Y-axis in FIG. 1.

A left-hand side of the above equation represents a magnetic flux density produced by a magnetic field applied to the magnetic material layer 14 as a vector in the above orthogonal coordinate system. A right-hand side of the above equation is a product of relative magnetic permeability of the magnetic material layer 14 represented as a matrix in the above orthogonal coordinate system and the magnetic field represented as a vector, where μy (real part) may value, e.g., 50.

The above equation represents a characteristic of anisotropic magnetic material to work on a magnetic field component in a direction of the hard magnetization axis with magnetic permeability proper to the magnetic material, and not to work on a magnetic field component in another direction as magnetic material (to provide magnetic permeability of free space).

If the antenna element 11 is excited, an antenna current is distributed along the Z-axis, in a long side direction of the antenna element 11 which is perpendicular to the hard magnetization axis of the magnetic material layer 14.

If it is assumed that the PCB 10 lacks the magnetic material layer 14, a magnetic field induced by the above antenna current mainly in the direction parallel to the Y-axis may be concentrated around a portion of the conductive layer 13 near the antenna element 11. As a result, a radio frequency (RF) current of an opposite phase against the antenna current may be induced in the conductive layer 13, causing radiation efficiency of the antenna device 1 to be degraded.

As the PCB 10 is provided with the magnetic material layer 14, the relative magnetic permeability μy may work on the magnetic field induced mainly in the direction parallel to the Y-axis so as to ease the concentration of the magnetic field around the antenna element 11, and the magnetic field may be distributed along the Y-axis while being spread to a certain extent. As a result, directions of RF current components induced in the conductive layer 13 may vary depending on locations, and the radiation efficiency of the antenna device 1 may be degraded less than the radiation efficiency on the assumption that the PCB 10 lacks the magnetic material layer 14.

If the hard magnetization axis of the magnetic material layer 14 is directed parallel to the X-axis or to the Z-axis, magnetic permeability in a direction parallel to the Y-axis equals the magnetic permeability of free space, thus causing a same result as described on the assumption that the PCB 10 lacks the magnetic material layer 14.

What is described above has been verified by simulation, and results of the simulation will be explained with reference to FIGS. 2-5. FIG. 2 is a sectional view of the PCB 10 and the antenna element 11 at a section shown by a dot-and-dash line "A-A" depicted in FIG. 1, to show conditions of the simulation. Each of reference numerals, an X-axis and a Y-axis shown in FIG. 2 is a same as the corresponding one shown in the perspective view of FIG. 1.

The simulation has been done under a condition that the PCB 10 is a conductive plate being 1 mm thick (equivalent to the conductive layer 13) provided with the magnetic material layer 14. The antenna element 11 has a circular section being 4 mm long in diameter. The antenna element 11 is arranged 3 mm away from an upper face of the magnetic material layer 14. For the simulation, it has been assumed that a frequency is 500 MHz, the real part of the relative magnetic permeability $\mu y$ in the direction of the hard magnetization axis of the magnetic material layer 14 values 50, and magnetic loss tangent (tan $\delta$) of the magnetic material layer 14 values 0.1.

Figure 3:
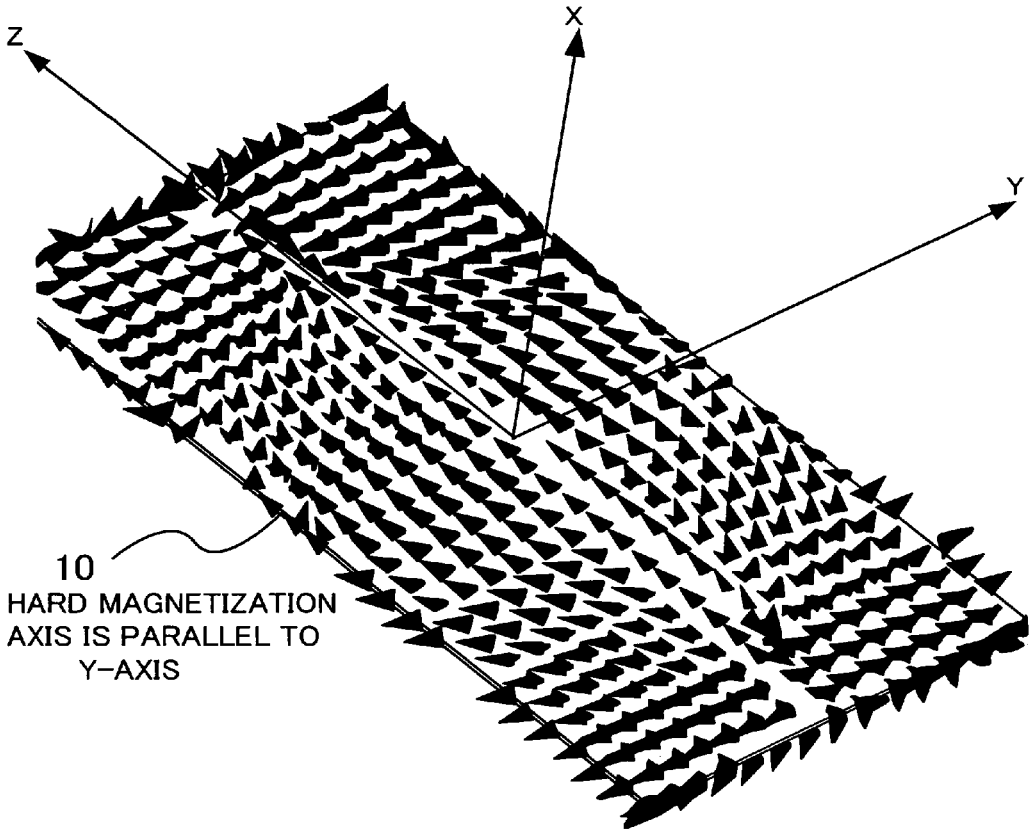
FIG. 3 is an analytical diagram to show distribution of RF current components in the PCB of the first embodiment simulated where a hard magnetization axis of the magnetic material layer is parallel to a Y-axis shown in FIG. 1.
Figure 4:
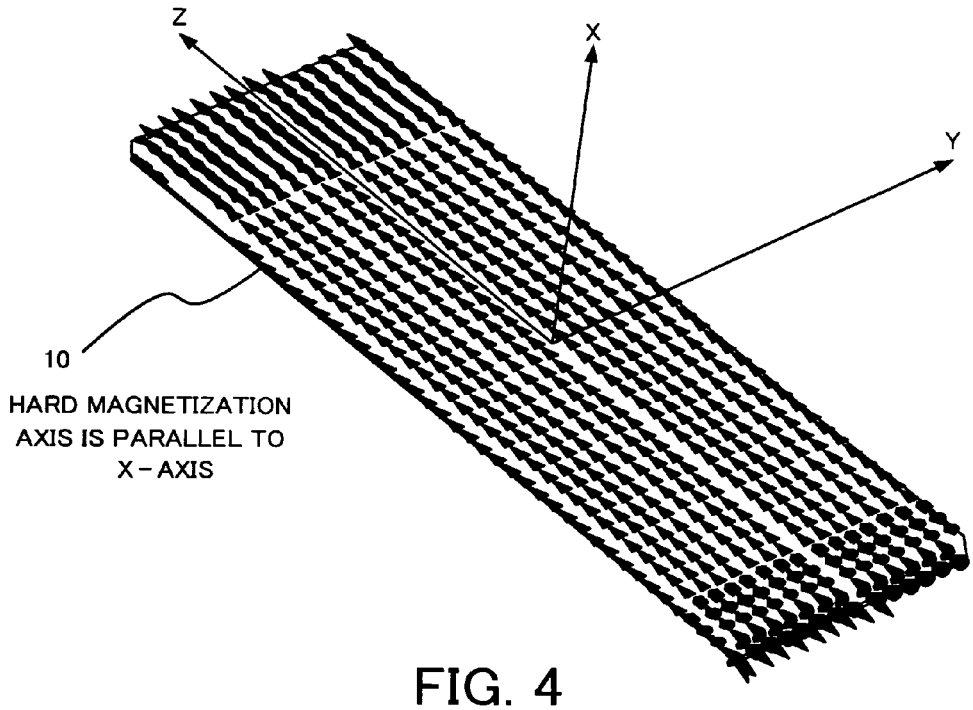
FIG. 4 is an analytical diagram to show distribution of RF current components in the PCB of the first embodiment simulated on an assumption that the hard magnetization axis is parallel to a X-axis shown in FIG. 1.

FIG. 3 is an analytical diagram to show simulated distribution of the RF current components in the conductive layer 13 of the antenna device 1, where the hard magnetization axis of the magnetic material layer 14 is parallel to the Y-axis. FIG. 4 is an analytical diagram to show simulated distribution of the RF current components in the conductive layer 13 on an assumption that the hard magnetization axis of the magnetic material layer 14 is parallel to the X-axis.

Figure 5:
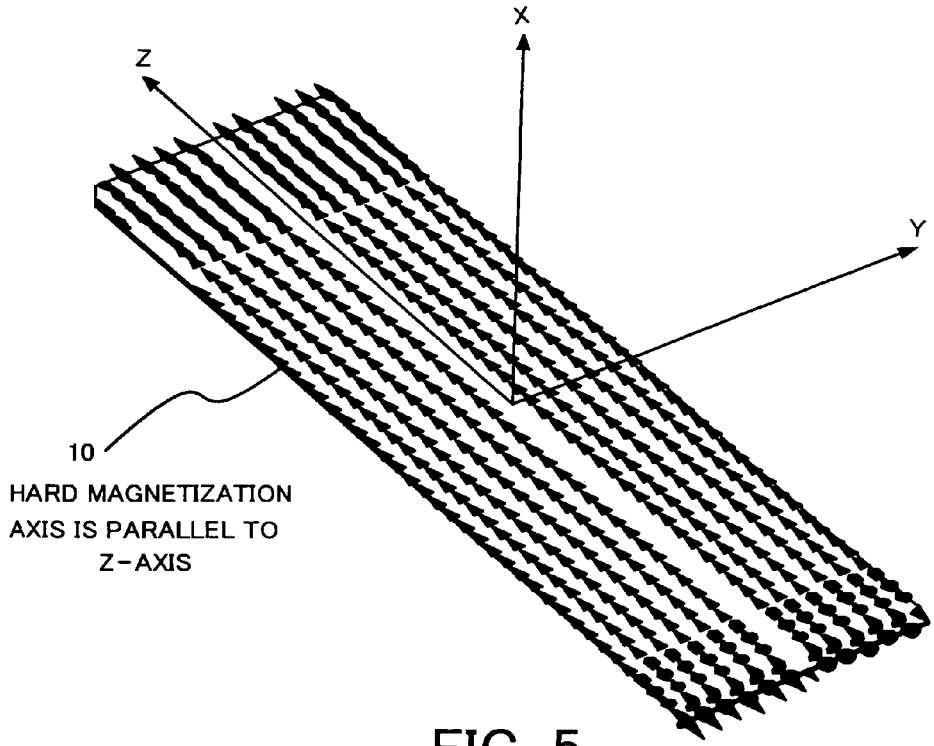
FIG. 5 is an analytical diagram to show distribution of RF current components in the PCB of the first embodiment simulated on an assumption that the hard magnetization axis is parallel to a Z-axis shown in FIG. 1.

FIG. 5 is an analytical diagram to show simulated distribution of the RF current components in the conductive layer 13 on an assumption that the hard magnetization axis of the magnetic material layer 14 is parallel to the Z-axis. In the above FIGS. 3-5, a triangle-like symbol depicted at each location on the face of the PCB 10 shows a direction of the RF current component at the location indicated by a sharp peak of the triangle.

FIG. 3 and FIG. 4 may be compared with each other as follows. In FIG. 4, the RF current components are almost uniformly directed parallel to the Z-axis near the antenna element 11, while in FIG. 3, some of the RF current components are directed parallel to the Y-axis even near the antenna element 11. In FIG. 3, RF current components in the direction of the Z-axis and of an opposite phase may be reduced as much so that the radiation efficiency of the antenna device 1 may be less degraded. FIG. 5 shows almost a same result as shown in FIG. 4.

The radiation efficiency of the antenna device 1 has been estimated by the above simulation to be −0.86 dB. Radiation efficiency of a few modifications of the antenna device 1 has been similarly estimated: to be −9.5 dB for a modification where the PCB 10 lacks the magnetic material layer 14; to be −8.2 dB for a modification where the hard magnetization axis of the magnetic material layer 14 is directed parallel to the X-axis; to be −7.9 dB for a modification where the hard magnetization axis of the magnetic material layer 14 is directed parallel to the Z-axis; and to be −1.2 dB where the magnetic material layer 14 is made of isotropic magnetic material. For the antenna device 1 and for the modification using the isotropic magnetic material, wavelength shortening effects have also been observed.

According to the first embodiment of the present invention described above, the antenna device may have the radiation efficiency less degraded by being provided with the anisotropic magnetic material layer between the antenna element and the conductive layer of the PCB, where the hard magnetization axis of the magnetic material layer is directed perpendicular to the direction of the antenna current.

Figure 6:
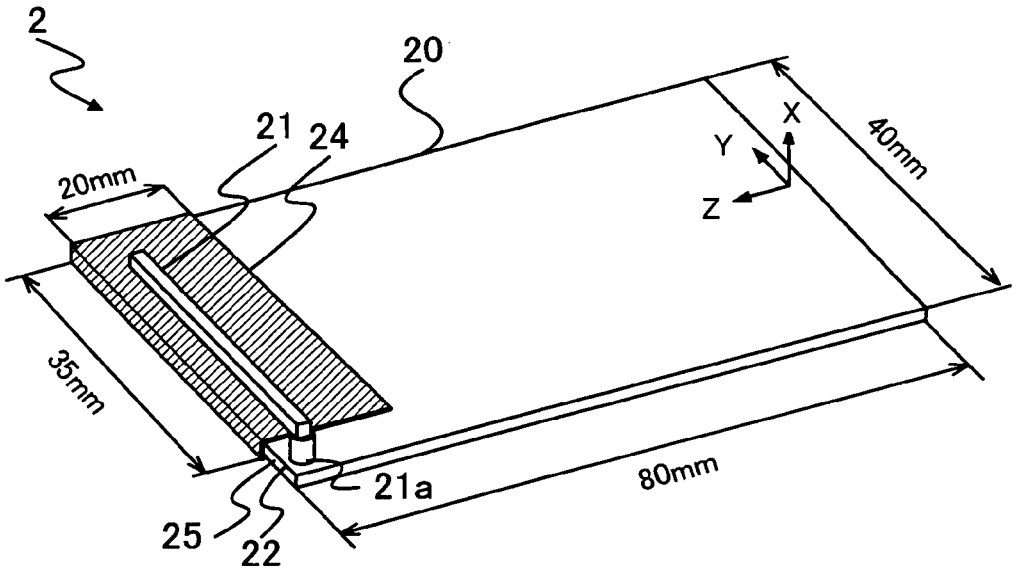
FIG. 6 is a perspective view of an antenna device of a second embodiment of the present invention, including an antenna element, a PCB and a magnetic material layer.

A second embodiment of the present invention will be described with reference to FIGS. 6-8. FIG. 6 is a perspective view of an antenna device 2 of the second embodiment of the present invention to show a configuration of the antenna device 2. In FIG. 6, parameter values of simulation which will be explained later, such as a length of each portion of the antenna device 2, are shown for convenience of explanation. Being considered as exemplary only, the parameter values shown in FIG. 6 will not limit the present invention.

The antenna device 2 has a PCB 20 and an antenna element 21. On an upper face of the PCB 20, a conductive layer (not shown) is provided in an area including a left edge 22 and is further overlaid with a magnetic material layer 24. The magnetic material layer 24 is also provided on an edge face 25 as continued from the left edge 22. The magnetic material layer 24 may be provided in an area of a lower face (not shown) of the PCB 20 as continued from the edge face 25.

The antenna element 21 is a quarter-wavelength monopole antenna configured to be unbalanced-fed at a feed portion 21*a* near the left edge 22. The antenna element 21 is arranged almost parallel to the left edge 22 on a side of the upper face of the PCB 20.

The PCB 20 is 80 mm long on a long side and 40 mm long on a short side. The left edge 22 earlier explained is one of the short sides as shown in FIG. 6, but may possibly be one of the long sides of the PCB 20. For convenience of explanation hereafter, an orthogonal coordinate system is defined to have an X-axis which is almost perpendicular to the face of the PCB 20, a Y-axis which is almost parallel to the short side of the PCB 20, and a Z-axis which is almost parallel to the long side of the PCB 20.

The magnetic material layer 24 is made of anisotropic magnetic material like the magnetic material layer 14 of the first embodiment, and is arranged in such a way that a hard magnetization axis of the magnetic material layer 24 is directed parallel to the Z-axis shown in FIG. 6. If the antenna element 21 is excited, an antenna current is distributed in a direction of the Y-axis which is almost parallel to the short side of the PCB 20, i.e., almost perpendicular to the hard magnetization axis of the magnetic material layer 24.

If the unbalanced antenna element 21 is excited on an assumption that the PCB 20 lacks the magnetic material layer 24, an antenna current is induced from the feed portion 21*a* and in a direction parallel to the Y-axis in the conductive layer of the PCB 20, and the antenna current is distributed or concentrated around the antenna element 21. The above antenna current distributed in the direction parallel to the Y-axis in the conductive layer of the PCB 20 and an antenna current distributed along the antenna element 21 are of opposite phase to each other, thus causing radiation efficiency of the antenna device 2 to be degraded.

As the PCB 20 is provided with the magnetic material layer 24 and the hard magnetization axis is almost perpendicular to the direction of the antenna current, concentration of the RF current distributed within the conductive layer of the PCB 20 may be eased around the antenna element 21 in such a manner as described regarding the first embodiment. Thus, the radiation efficiency of the antenna device 2 may be degraded less than the radiation efficiency on the assumption that the PCB 20 lacks the magnetic material layer 24.

If the hard magnetization axis of the magnetic material layer 24 is directed parallel to the X-axis or to the Y-axis, caused is a same result as described on the assumption that the PCB 20 lacks the magnetic material layer 24 for a same reason as described regarding the first embodiment.

What is described above has been verified by simulation, and results of the simulation will be explained with reference to FIG. 7 and FIG. 8. For the simulation, it has been assumed that a frequency is 2 gigahertz (GHz), a real part of relative magnetic permeability in the direction of the hard magnetization axis of the magnetic material layer 24 values 50, and magnetic loss tangent (tan δ) of the magnetic material layer 24 values 0.01. For convenience, the PCB 20 is assumed to be a conductor plate which is 1 mm thick.

Figure 7:
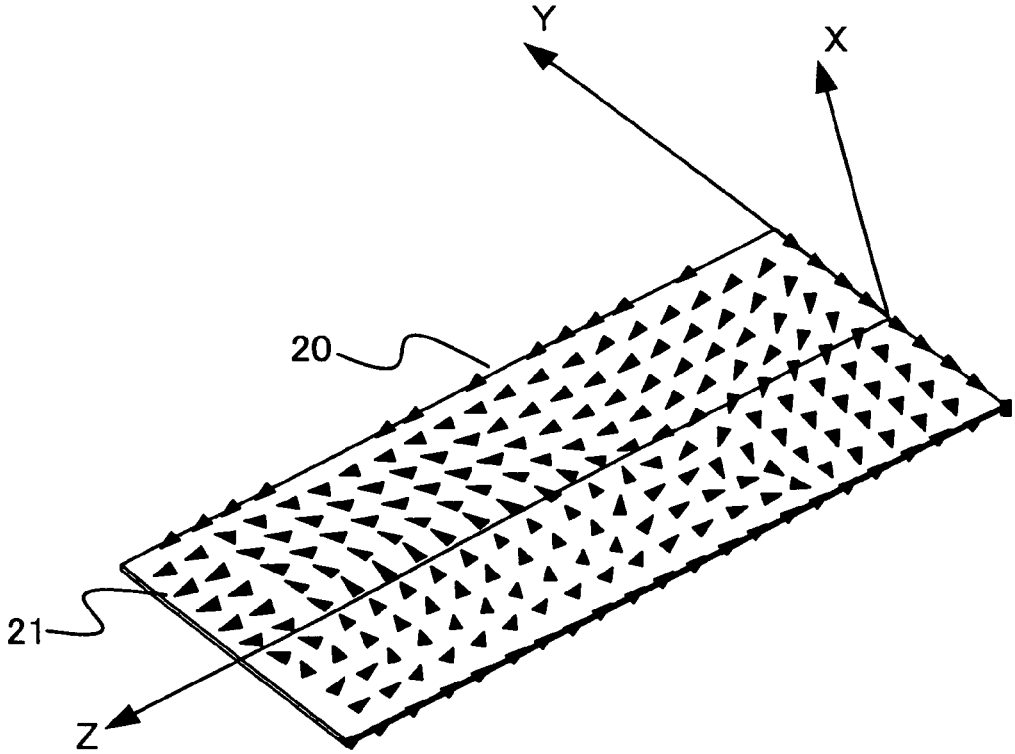
FIG. 7 is an analytical diagram to show distribution of RF current components in the PCB of the second embodiment simulated where the hard magnetization axis is parallel to a Z-axis shown in FIG. 6.

FIG. 7 is an analytical diagram to show simulated distribution of the RF current components in the PCB 20 of the antenna device 2, where the hard magnetization axis of the magnetic material layer 24 is parallel to the Z-axis. FIG. 8 is an analytical diagram to show simulated distribution of the RF current components in the PCB 20 on an assumption that the hard magnetization axis of the magnetic material layer 24 is parallel to the Y-axis. In the above FIGS. 7-8, a triangle-like symbol depicted at each location on the face of the PCB 20 shows a direction of the RF current component at the location indicated by a sharp peak of the triangle.

Figure 8:
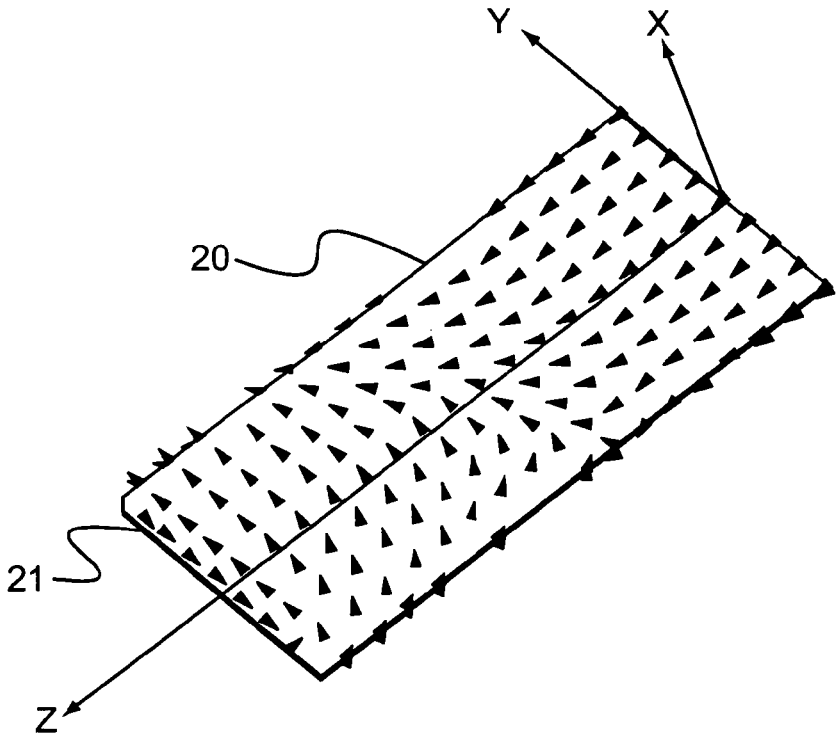
FIG. 8 is an analytical diagram to show distribution of RF current components in the PCB of the second embodiment simulated on an assumption that the hard magnetization axis is parallel to a Y-axis shown in FIG. 6.

FIG. 7 and FIG. 8 may be compared with each other as follows. In FIG. 8, RF current components are almost uniformly directed parallel to the Y-axis near the antenna element 21, while in FIG. 7, some of the RF current components are directed parallel to the Z-axis even near the antenna element 21. In FIG. 7, RF current components distributed parallel to the Y-axis and of an opposite phase may be reduced as much so that the radiation efficiency of the antenna device 2 may be less degraded.

The radiation efficiency of the antenna device 2 has been estimated by the above simulation to be −0.5 dB. Meanwhile, radiation efficiency on an assumption that the hard magnetization axis of the magnetic material layer 23 is directed parallel to the Y-axis has been estimated to be −1.4 dB.

Figure 9:
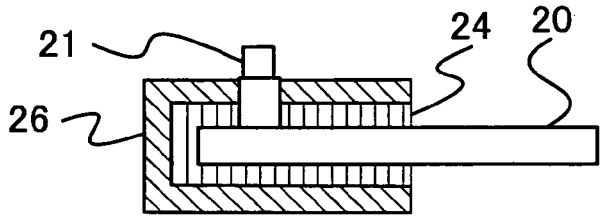
FIG. 9 is a side view of a modification of the second embodiment configured that the magnetic material layer is overlaid with a dielectric material layer.
Figure 10:
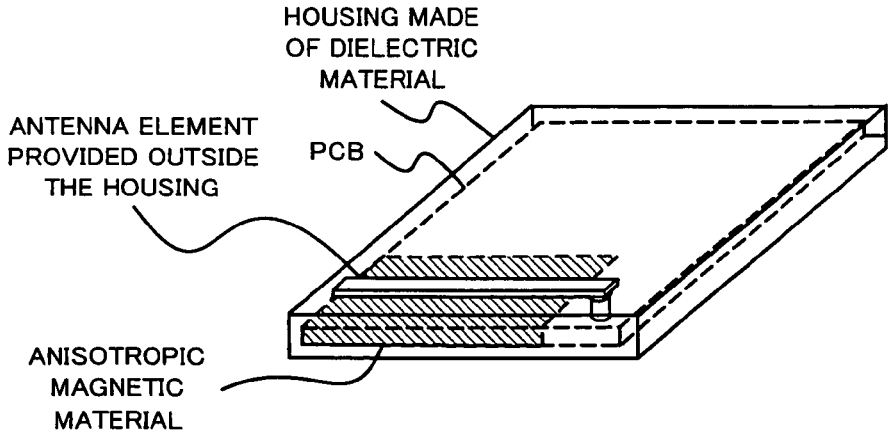
FIG. 10 is a perspective view of an example of the modification of the second embodiment.

A modification of the second embodiment will be explained with reference to FIGS. 9-12. FIG. 9 is a side view of the modification configured that the magnetic material 24 of the antenna device 2 is overlaid with a dielectric material layer 26 as viewed in the direction of the Y-axis shown in FIG. 6. The reference numerals 20, 21 and 24 are common to FIG. 6 and FIG. 9. The side view shown in FIG. 9 may simulate a configuration as shown in FIG. 10, e.g., where a PCB is contained in a housing made of dielectric material on which an antenna element is provided on an outer surface of the housing, and a piece of anisotropic magnetic material is provided in an area of a surface of the PCB near the antenna element.

If the antenna element 21 is excited on an assumption that the configuration shown in FIG. 9 lacks the magnetic material layer 24, an electric field produced around the antenna element 21 tends to be concentrated in the dielectric material layer 26 of a relatively higher permitivity. The electric field is likely to be coupled to the PCB 20 to produce a current of an opposite phase, thus causing radiation efficiency to be degraded.

As the PCB 20 is provided with the magnetic material layer 24 having the hard magnetization axis directed almost perpendicular to the direction of the antenna current, the radiation efficiency may be less degraded in such a manner as described regarding the first embodiment and the second embodiment.

What is described above has been verified by simulation, and results of the simulation will be explained with reference to FIG. 11 and FIG. 12. The simulation has been done under same conditions as applied in FIGS. 7-8, plus a condition that the dielectric material layer 25 is 1 mm thick.

Figure 11:
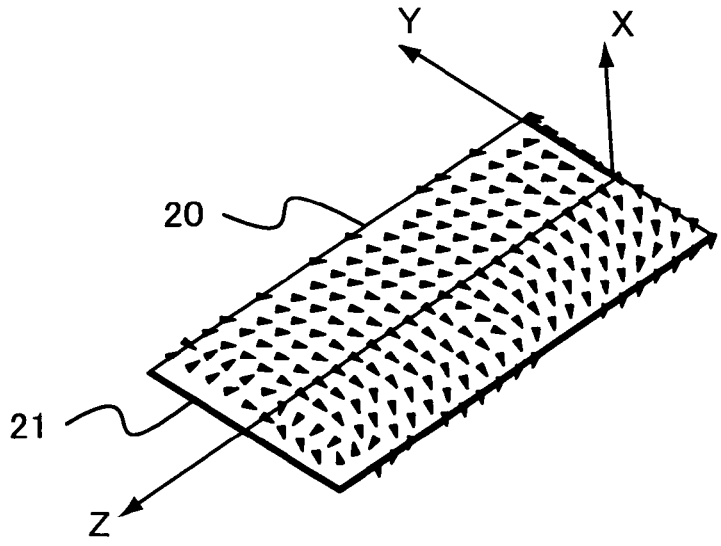
FIG. 11 is an analytical diagram to show distribution of RF current components in the PCB of the modification of the second embodiment, where the hard magnetization axis of the magnetic material layer is parallel to the Z-axis.

FIG. 11 is an analytical diagram to show simulated distribution of the RF current components in the PCB 20 of the modification of the second embodiment, where the hard magnetization axis of the magnetic material layer 24 is directed parallel to the Z-axis. FIG. 12 is an analytical diagram to show simulated distribution of the RF current components in the PCB 20 without the magnetic material layer 24. In the above FIGS. 11-12, a triangle-like symbol depicted at each location on the face of the PCB 20 shows a direction of the RF current component at the location indicated by a sharp peak of the triangle.

Figure 12:
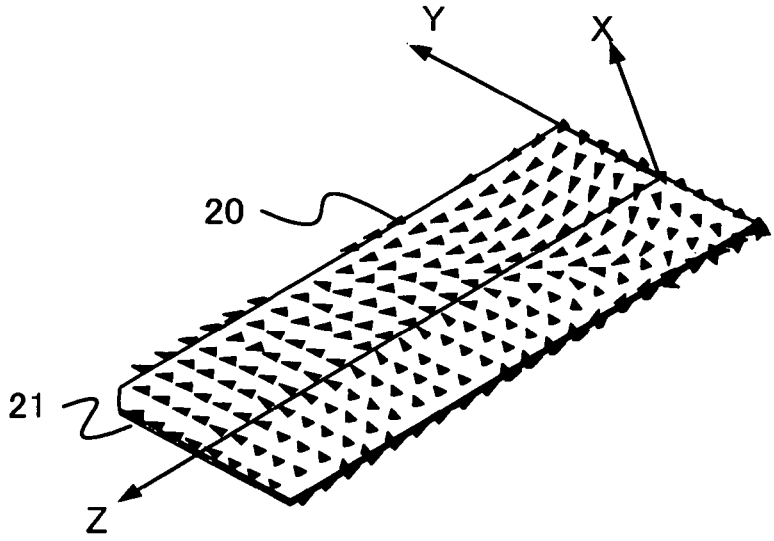
FIG. 12 is an analytical diagram to show distribution of RF current components in the PCB of the modification of the second embodiment without the magnetic material layer.

FIG. 11 and FIG. 12 may be compared like FIG. 7 and FIG. 8, and in FIG. 11 the radiation efficiency may be relatively less degraded. The radiation efficiency of the configuration where the dielectric material layer 26 is added to the antenna device 2 has been estimated by the above simulation to be −0.56 dB. Meanwhile, the radiation efficiency without the magnetic material layer 24 has been estimated to be −2.8 dB.

According to the second embodiment of the present invention described above, the radiation efficiency of the unbalanced-fed antenna element provided near the side of the PCB in a generic configuration of mobile radio apparatus may be less degraded by being provided with the anisotropic magnetic material layer between the antenna element and the conductive layer of the PCB, where the hard magnetization axis of the magnetic material layer is directed perpendicular to the direction of the antenna current.

Figure 13:
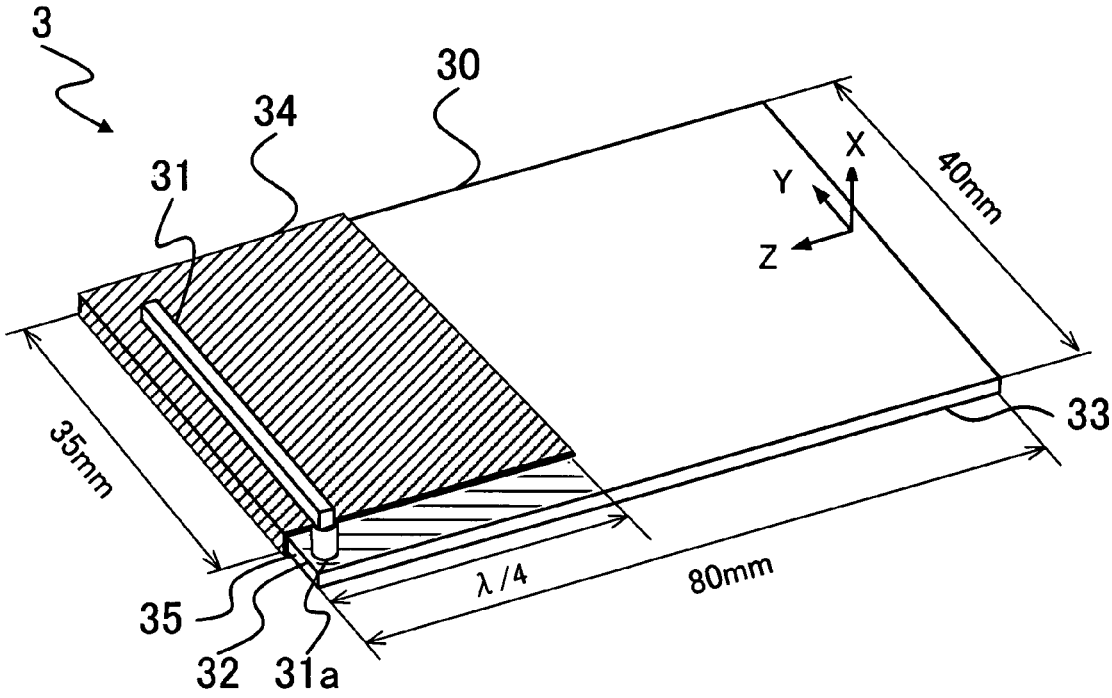
FIG. 13 is a perspective view of an antenna device of a third embodiment of the present invention, including an antenna element, a PCB and a magnetic material layer.

A third embodiment of the present invention will be described with reference to FIG. 13 and FIG. 14. FIG. 13 is a perspective view of an antenna device 3 of the third embodiment of the present invention to show a configuration of the antenna device 3. In FIG. 13, parameter values of simulation which will be explained later, such as a length of each portion of the antenna device 3, are shown for convenience of explanation. Being considered as exemplary only, the parameter values shown in FIG. 6 will not limit the present invention.

The antenna device 3 has a PCB 30 and an antenna element 31. On an upper face of the PCB 30, conductive layers (not shown) are provided in an area including a portion of a left edge 32 and in an area including a portion of a lower edge 33.

In the area including the portion of the left edge 32, the above conductive layer is overlaid with a magnetic material layer 34 (indicated by slanted hatching) made of anisotropic magnetic material by a length of one-quarter wavelength of a frequency of use in a direction almost parallel to the lower edge 33. In the area including the portion of the lower edge 33 (indicated by horizontal hatching, and hereinafter called the lower edge area), the conductive layer is provided with no magnetic material layer. The magnetic material layer 34 is also provided on an edge face 35 as continued from the left edge 32. The magnetic material layer 34 may be provided in an area of a lower face (not shown) of the PCB 30 as continued from the edge face 35.

The antenna element 31 is a quarter-wavelength monopole antenna configured to be unbalanced-fed at a feed portion 31*a* near the left edge 32. The antenna element 31 is provided on a side of the upper face of the PCB 20 almost parallel to the left edge 32.

The PCB 30 is 80 mm long on a long side and 40 mm long on a short side. The left edge 32 earlier explained is one of the short sides as shown in FIG. 14, but may possibly be one of the long sides of the PCB 30. For convenience of explanation hereafter, an orthogonal coordinate system is defined to have an X-axis which is almost perpendicular to the face of the PCB 20, a Y-axis which is almost parallel to the short side of the PCB 30, and a Z-axis which is almost parallel to the long side of the PCB 30.

The magnetic material layer 34 is made of anisotropic magnetic material like the magnetic material layer 14 of the first embodiment, and is arranged in such a way that a hard magnetization axis of the magnetic material layer 34 is directed parallel to the Z-axis shown in FIG. 13. If the antenna element 31 is excited, an antenna current is distributed in a direction of the Y-axis which is almost parallel to the short side of the PCB 30, i.e., almost perpendicular to the hard magnetization axis of the magnetic material layer 34.

As the antenna element 31 is unbalanced-fed, an RF current also flows in the conductive layer of the PCB 30. As influence of a magnetic field induced by the antenna element 31 is shielded by the magnetic material layer 34 in the area of the PCB 30 covered by the magnetic material layer 34, the RF current is distributed mainly in the lower edge area of the PCB 30. As the lower edge area is sized to be one-quarter wavelength long to satisfy a resonance condition, and does not cancel out the antenna current which is perpendicularly directed, the above RF current may contribute to radiation efficiency.

It is known that an RF current flows in a conductive layer of a PCB when an unbalanced-fed antenna is used, and that a direction of the RF current may be controlled by an inward cut of a portion of the PCB. This way of using the inward cut is, however, disadvantageous as reducing mounting space of the PCB. The antenna device 3 of the third embodiment is advantageous as needing no inward cut of a portion of the PCB for such control.

What is described above has been verified by simulation, and results of the simulation will be explained with reference to FIG. 14. The simulation has been done under conditions that a frequency is 2 GHz, a real part of relative magnetic permeability in the direction of the hard magnetization axis of the magnetic material layer 34 values 50, and magnetic loss tangent (tan δ) of the magnetic material layer 34 values 0.01. For convenience, the PCB 30 is assumed to be a conductor plate which is 1 mm thick.

Figure 14:
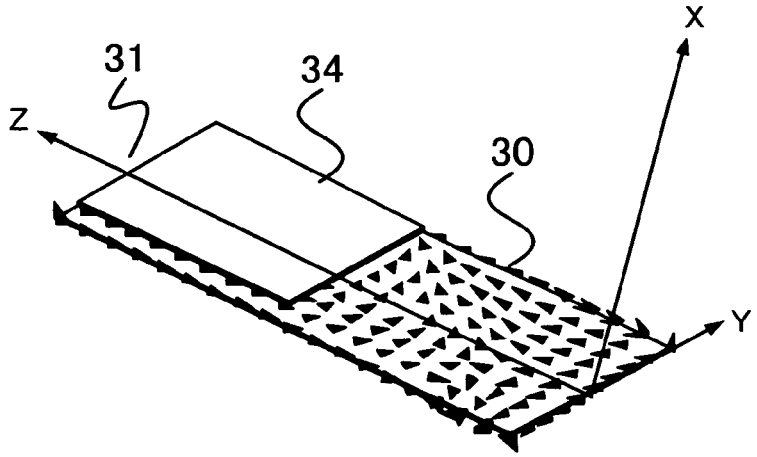
FIG. 14 is an analytical diagram to show simulated distribution of RF current components in the PCB of the third embodiment.

FIG. 14 is an analytical diagram to show simulated distribution of RF current components in the PCB 30. In FIG. 14, a triangle-like symbol depicted at each location on the face of the PCB 30 shows a direction of the RF current component at the location indicated by a sharp peak of the triangle.

The RF current which flows in the conductive layer of the PCB 30 is distributed in the lower edge area by the length of one-quarter wavelength being parallel to the Z-axis. In an area of the PCB 30 not covered by the magnetic material layer 34 and far from the antenna element 31, a low-level RF current is distributed parallel to the Y-axis. Owing to such control of the directions of the RF currents, radiation efficiency of the antenna device 3 may be less degraded.

The radiation efficiency of the antenna device 3 has been estimated by the above simulation to be −0.56 dB. Meanwhile, the radiation efficiency without the magnetic material layer 34 has been estimated to be −1.4 dB.

Figure 15:
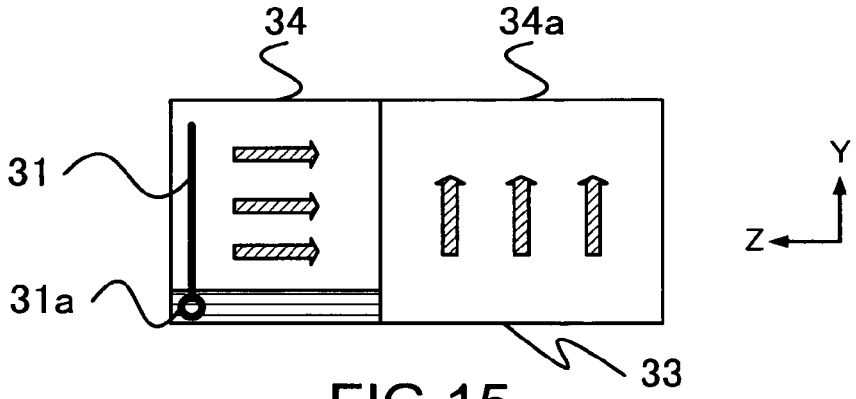
FIG. 15 is a top view of a first modification of the third embodiment.

A first one of two modifications of the third embodiment will be described with reference to FIG. 15, a top view of the first modification as viewed from a front of the X-axis shown in FIG. 13. The first modification is configured that an area of the conductive layer of the PCB 30, earlier explained regarding the third embodiment, far from the antenna element 31 is covered by a magnetic material layer 34*a* made of anisotropic magnetic material. The reference numerals 31, 31*a*, 33 and 34, the Y-axis and the Z-axis are common to FIG. 13 and FIG. 15. Each of block arrows shown in FIG. 15 represents a direction of the hard magnetization axis of one of the magnetic material layers 34 and 34*a*.

In the area far from the antenna element 31 covered by the magnetic material layer 34*a*, an RF current which flows along the lower edge 33 toward the feed portion 31*a* may be controlled by an effect of the magnetic material layer 34*a* having the hard magnetization axis directed perpendicular to the direction of the above RF current.

Figure 16:
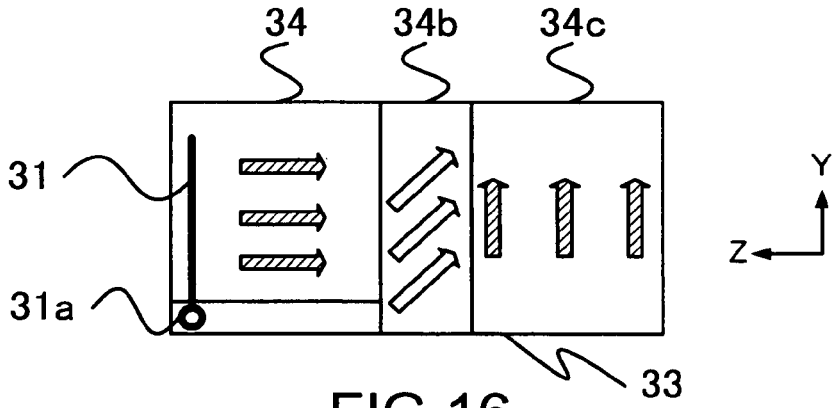
FIG. 16 is a top view of a second modification of the third embodiment.

A second one of the two modifications of the third embodiment will be described with reference to FIG. 16, a top view of the second modification as viewed from the front of the X-axis shown in FIG. 13. The second modification is configured that an area of the conductive layer of the PCB 30, earlier explained regarding the third embodiment, far from the antenna element 31 is covered by magnetic material layers 34*b* and 34*c*, both made of anisotropic magnetic material. The reference numerals 31, 31*a*, 33 and 34, the Y-axis and the Z-axis are common to FIG. 13 and FIG. 16. Each of block arrows shown in FIG. 16 represents a direction of the hard magnetization axis of one of the magnetic material layers 34, 34*b* and 34*c*.

The magnetic material layer 34*c* may control the RF current which flows along the lower edge 33 toward the feed portion 31*a* by having the hard magnetization axis directed perpendicular to the direction of the above RF current in a same way as the magnetic material layer 34*a* does. The magnetic material layer 34*b* has a hard magnetization axis in a direction of a vector sum of the hard magnetization axes of the magnetic material layers 34 and 34*c*. This configuration may help the RF current smoothly change the direction at a border between the magnetic material layers 34 and 34*c*, or between 34*c* and 34*b*.

According to the third embodiment of the present invention described above, the antenna device using the unbalanced-fed antenna element may control the direction of the RF current which flows in the conductive layer of the PCB so that the radiation efficiency may be less degraded, by being provided with the anisotropic magnetic material layer between the antenna element and the conductive layer, where the hard magnetization axis of the magnetic material layer is directed perpendicular to the direction of the antenna current.

The particular hardware or software implementation of the pre-sent invention may be varied while still remaining within the scope of the present invention. It is therefore to be understood that within the scope of the appended claims and their equivalents, the invention may be practiced otherwise than as specifically described herein.

What is claimed is:

1. An antenna device, comprising:

a printed circuit board having a face, wherein at least a portion of the face is formed by a conductive layer overlaid with a magnetic material layer made of anisotropic magnetic material, and the magnetic material layer is arranged in such a way that a hard magnetization axis of the anisotropic magnetic material is directed substantially parallel to the face; and an antenna element arranged substantially parallel to the printed circuit board on a side of the face, wherein the antenna element is arranged in such a way that an antenna current distributed on the antenna element if the antenna element is excited is directed substantially perpendicular to the hard magnetization axis.

2. The antenna device of claim 1, wherein the antenna element is configured to be balanced-fed.

3. The antenna device of claim 1, wherein the magnetic material layer is made of one of nanogranular material and nanocolumnar material.

4. An antenna device, comprising:

a printed circuit board having a first face and a second face, wherein a conductive layer is overlaid with a magnetic material layer made of anisotropic magnetic material in an area of the first face including a portion of an edge of the first face, the magnetic material layer is further provided to an edge face of the printed circuit board continuing from the edge of the first face, and the magnetic material layer is arranged in such a way that a hard magnetization axis of the anisotropic magnetic material is directed substantially parallel to the first face and substantially perpendicular to the edge of the first face; and an antenna element configured to be unbalanced-fed near the edge of the first face, wherein the antenna element is arranged substantially parallel to the edge of the first face, and the antenna element is arranged in such a way that an antenna current distributed on the antenna element if the antenna element is excited is directed substantially perpendicular to the hard magnetization axis.

5. The antenna device of claim 4, wherein the magnetic material layer is made of one of nanogranular material and nanocolumnar material.

6. The antenna device of claim 4, wherein the magnetic material layer made of anisotropic magnetic material is further provided to an area of the second face continuing from the edge face.

7. The antenna device of claim 4, further comprising a dielectric material layer between the magnetic material layer and the antenna element.

8. An antenna device, comprising:

a printed circuit board having a first face and a second face, wherein the first face has a first area including a portion of a first edge of the first face, the first face has a second area including a portion of a second edge of the first face neighboring the first edge, each of the first area and the second area has a conductive layer, in the first area the conductive layer is overlaid with a magnetic material layer made of anisotropic magnetic material over a length of one-quarter wavelength of a frequency of use in a direction substantially parallel to the second edge, the magnetic material layer is further provided to an edge face of the printed circuit board continuing from the first edge, and the magnetic material layer is arranged in such a way that a hard magnetization axis of the anisotropic magnetic material is directed substantially parallel to the first face and substantially perpendicular to the first edge; and an antenna element configured to be unbalanced-fed near the first edge and the second edge, wherein the antenna element is arranged substantially parallel to the first edge, and the antenna element is arranged in such a way that an antenna current distributed on the antenna element if the antenna element is excited is directed substantially perpendicular to the hard magnetization axis.

9. The antenna device of claim 8, wherein the magnetic material layer is made of one of nanogranular material and nanocolumnar material.

10. The antenna device of claim 8, wherein the magnetic material layer made of anisotropic magnetic material is further provided to an area of the second face continuing from the edge face.

11. The antenna device of claim 8, further comprising a dielectric material layer between the magnetic material layer and the antenna element.

12. The antenna device of claim 8, wherein the first face has a third area continuing from the first area, wherein in the third area a further conductive layer is overlaid with extra a further magnetic material layer made of extra further anisotropic magnetic material, and the extra magnetic material layer is arranged in such a way that a further hard magnetization axis thereof is directed substantially parallel to the first edge.

13. The antenna device of claim 8, wherein the first face has a third area continuing from the first area and a fourth area continuing from the third area;

wherein in the fourth area a first further conductive layer is overlaid with a first further magnetic material layer made of first further anisotropic magnetic material, and the first further magnetic material layer is arranged in such a way that a first further hard magnetization axis thereof is directed substantially parallel to the first edge; and wherein in the third area a second further conductive layer is overlaid with a second further magnetic material layer made of second further anisotropic magnetic material, and the second extra further magnetic material layer is arranged in such a way that a second extra further hard magnetization axis thereof is directed in a direction of a vector sum of the hard magnetization axis and the first further hard magnetization axis.

* * * * *